US006632095B2

(12) United States Patent
Ryan

(10) Patent No.: US 6,632,095 B2
(45) Date of Patent: Oct. 14, 2003

(54) TONGUE LIFTER

(76) Inventor: Bruce P. Ryan, 5416 Oleta St., Long Beach, CA (US) 90815

( * ) Notice: Subject to any disclaimer, the term of this patent is extended or adjusted under 35 U.S.C. 154(b) by 0 days.

(21) Appl. No.: 09/797,628

(22) Filed: Mar. 1, 2001

(65) Prior Publication Data

US 2001/0034474 A1 Oct. 25, 2001

Related U.S. Application Data

(60) Provisional application No. 60/187,948, filed on Mar. 1, 2000.

(51) Int. Cl.[7] ..... G09B 19/00
(52) U.S. Cl. ..... 434/185
(58) Field of Search ..... 434/185; 600/185, 600/190, 193, 198, 237

(56) References Cited

U.S. PATENT DOCUMENTS

| | | | | | |
|---|---|---|---|---|---|
| 779,360 | A | * | 1/1905 | Grummann | 434/185 |
| 4,579,108 | A | * | 4/1986 | Bauman | 128/10 |
| 4,718,662 | A | * | 1/1988 | North | 272/95 |
| 4,997,182 | A | * | 3/1991 | Kussick | 272/95 |
| 5,036,835 | A | * | 8/1991 | Filli | 128/11 |
| 5,213,553 | A | * | 5/1993 | Light | 482/11 |
| 5,257,930 | A | * | 11/1993 | Blakeley | 433/6 |
| 5,873,818 | A | * | 2/1999 | Rothfels | 600/188 |

OTHER PUBLICATIONS

Intra–Oral Therapy Tools, Speech Dynamics Incorporated Catalog 2001, p. 23.*

Nemoy, Elizabeth McGinley, et al., The Correction of Defective Consonant Sounds, a Teachers' Manual of Ear Training Stories and Motivated Lessons for Group or Individual Instruction, 1937, p. 144, Expression Company, Boston.

Baker, Richard D., et al., Sound Evocation Program II, Monterey Articulation Program, 1975, p. 47, Monterey Learning Systems, Palo Alto.

Hanson, Marvin L., Approaches to Articulation Training, Articulation, 1983, p. 148, W.B. Saunders Company, Philadelphia.

Weiss, Curtis E., et al., Elicit Sounds in the Simplest Way, Clinical Management of Articulatory and Phonologic Disorders, Second Edition, 1987, p. 174–175, Williams & Wilkins, Baltimore.

Bernthal, John E., et al., Instruction for Production of the /3˜/, Articulation and Phonological Disorders, Third Edition, 1993, p. 404, Prentice Hall, New Jersey.

Boshart, Char, The RRRRundown on How to RRRRemediate "R", Speech Dynamo, A Newsletter by Speech Dynamics, Inc., May 1998, vol. 5.

Intra–Oral Therapy Tools, Speech Dynamics Incorporated Catalog 2001, pp. 23, 35 and 38.

Oral–Motor Therapy Kit, imaginart, Bisbee, AZ, 1 page.

* cited by examiner

*Primary Examiner*—Kurt Fernstrom
(74) *Attorney, Agent, or Firm*—Christie, Parker & Hale, LLP

(57) ABSTRACT

A tongue lifting tool and method for using such tool are provided. The tool has a tongue holder for supporting a patient's tongue and a holding portion coupled to the tongue holder.

21 Claims, 3 Drawing Sheets

TONGUE LIFTER

CROSS REFERENCE TO RELATED APPLICATION

This application is based upon and claims priority on U.S. Provisional Application No. 60/187,948, filed on Mar. 1, 2000, which application is fully incorporated herein by reference.

BACKGROUND OF THE INVENTION

The present invention relates to tools for use in speech therapy and specifically to a tongue lifter.

It is believed that about 10% of American people have some kind of speech problem. The most common type of speech problem is an articulation problem where a person is unable to pronounce specific sounds of American English. The two sounds that most people have difficulty in pronouncing are the "esss" /s/ sound and the "er" /3˜/ sound. Of the two, most people have problems pronouncing the /3˜/ sound. Proper pronunciation of the /3˜/ sound requires elevation of the rear and middle portions of the tongue. This type of tongue elevation is hard to illustrate to a patient, thereby making it difficult to teach.

To teach proper tongue positioning for pronouncing the /3˜/ sound, many speech language pathologists currently use a common tongue depressor to elevate the tongue. The problem with a tongue depressor is that it offers inadequate support to the tongue and the tongue tends to roll off the depressor. Moreover, because a tongue depressor is planar, its edge is used to lift the tongue. Even though, the edge of the tongue depressor is sometimes rounded, use of the edge to lift the tongue may often result in injury, as for example, a laceration of the tongue.

Consequently, a tongue lifter is desired that can be used for positioning the tongue of a person in the appropriate elevated position for pronouncing the /3˜/ sound and for teaching such person the proper position of the tongue for pronouncing the /3˜/ sound. Moreover, a tongue lifter is desired that is capable of supporting the tongue at the appropriate position without risk of injury to the tongue.

DETAILED DESCRIPTION

Figure 1:
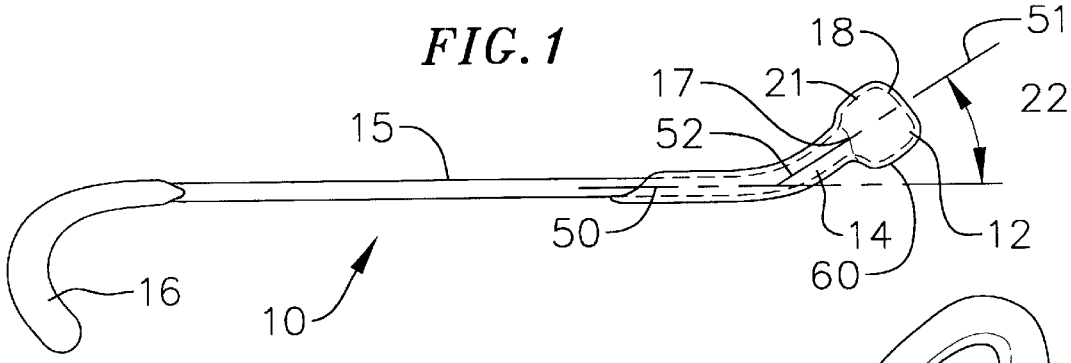
FIG. 1 is a side view of an exemplary embodiment tongue lifter of the present invention.

A tongue lifting tool or lifter is provided capable of lifting the tongue of a person in the appropriate position for proper pronunciation of various sounds as for example the "er" /3˜/ sound. An exemplary embodiment tongue lifter 10 shown in FIGS. 1, 2, 3 and 8 comprises tongue holder 12, a neck 14 extending from the tongue holder, a stem 15 extending from the neck and a handle 16 extending from the stem.

Figure 2:
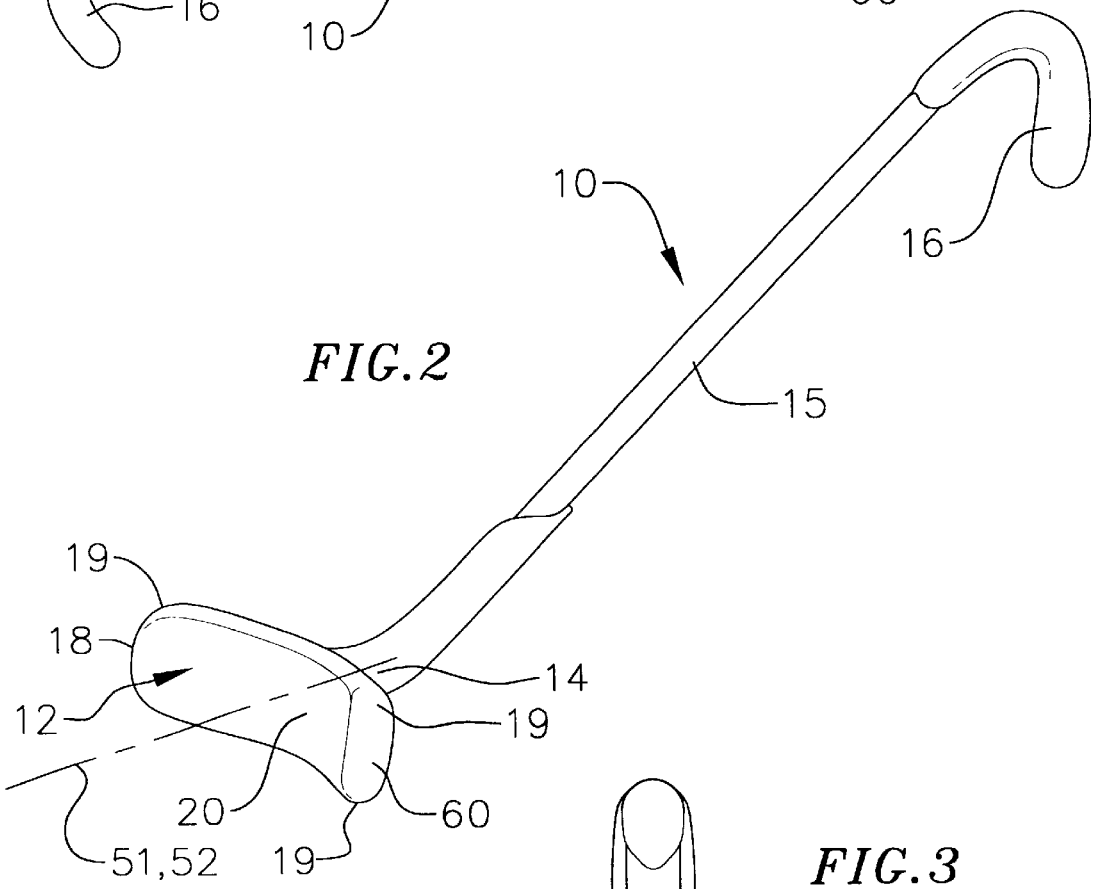
FIG. 2 is a perspective view of the exemplary embodiment tongue lifter shown in FIG. 1.
Figure 3:
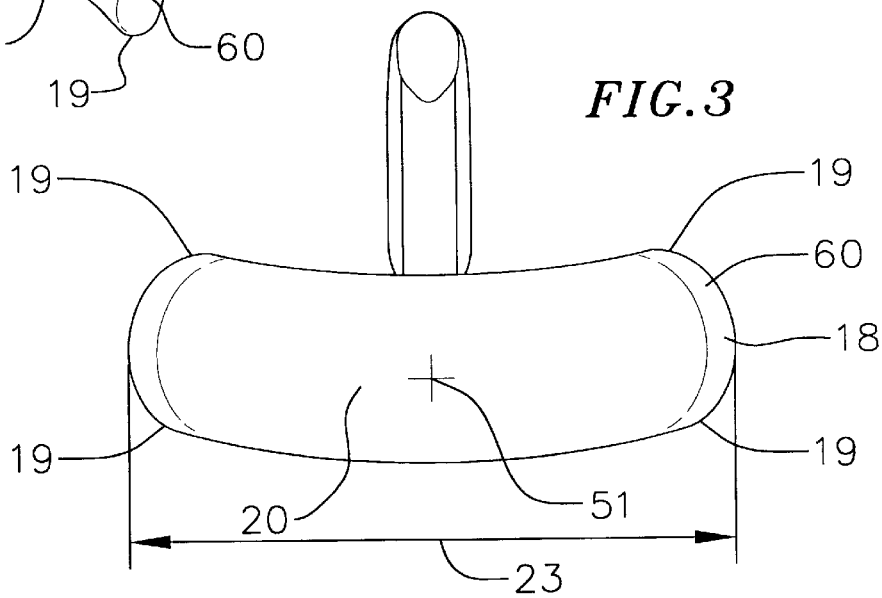
FIG. 3 is a front view of the exemplary embodiment tongue lifter shown in FIG. 1.

In the exemplary embodiment shown in FIGS. 1, 2 and 3, the holder is preferably a concave strip 18 curving away from the stem and neck and having rounded corners 19 as shown in FIG. 2 or 3 or may be another member having a bowl shaped or concave surface 20 for supporting the under surface of a patient's tongue. The holder outer surface 21 can be of any geometry.

In the exemplary embodiment lifter shown in FIG. 1, the neck 14 typically extends perpendicularly from the outer surface 21 of the holder and preferably from the apex 17 of the holder outer surface. A typical holder concave surface has a length 23 of about one and a half inches. However, the length can be varied for use by patients of different sizes. For example, a shorter length surface may be used for children while a longer length may be used for adults.

Figure 7:
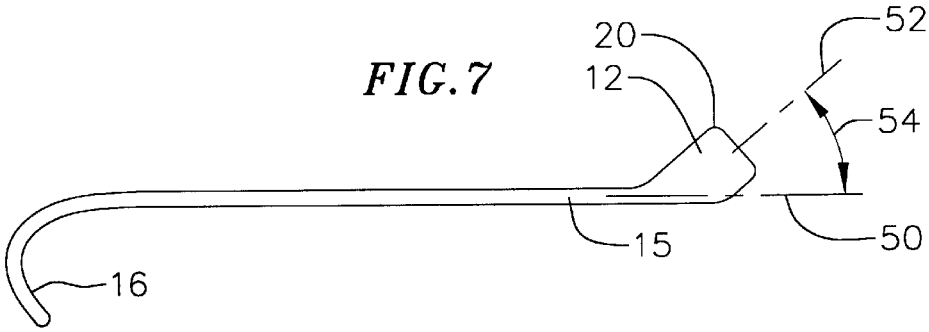
FIG. 7 is a side view of another exemplary embodiment tongue lifter of the present invention.
Figure 8:
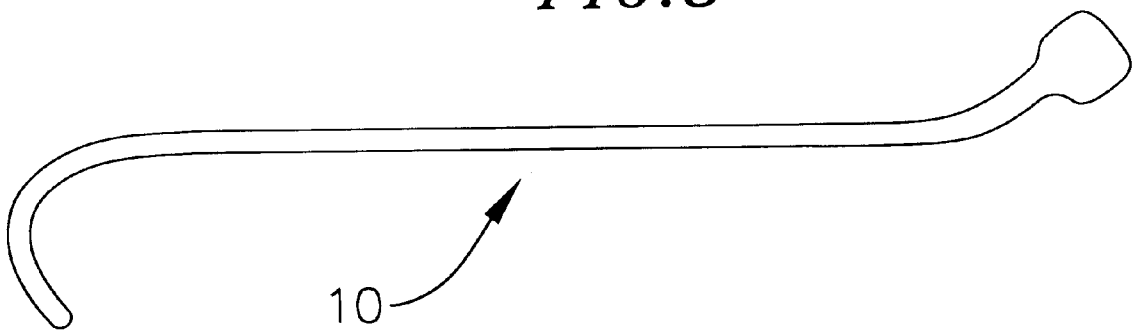
FIG. 8 is a side view of a further exemplary embodiment tongue lifter of the present invention.

In the exemplary embodiment shown in FIGS. 1 and 2 a normal central axis 51 of the tongue holder is offset from a central longitudinal axis 50 of the stem. In the exemplary embodiment shown in FIGS. 1 and 2, the holder central normal central axis 51 is aligned to a neck central longitudinal axis 52. In the shown exemplary embodiment the stem central longitudinal axis 50 extends from the neck central longitudinal axis 52 and thus from the holder normal central axis at an angle 22. The angle 22 is preferably less than 90° and more preferably the angle 22 is in the range of about 20° to 30°. In another exemplary embodiment as shown in FIG. 7, the tongue holder 12 may extend directly from the stem 15 at angle such that a central longitudinal axis 50 of the stem is offset from a normal central axis 51 extending from the tongue supporting surface 20 at an angle 54. Angle 54 is preferably less than 90° and more preferably the angle 22 is in the range of about 20° to 30°.

Figure 4:
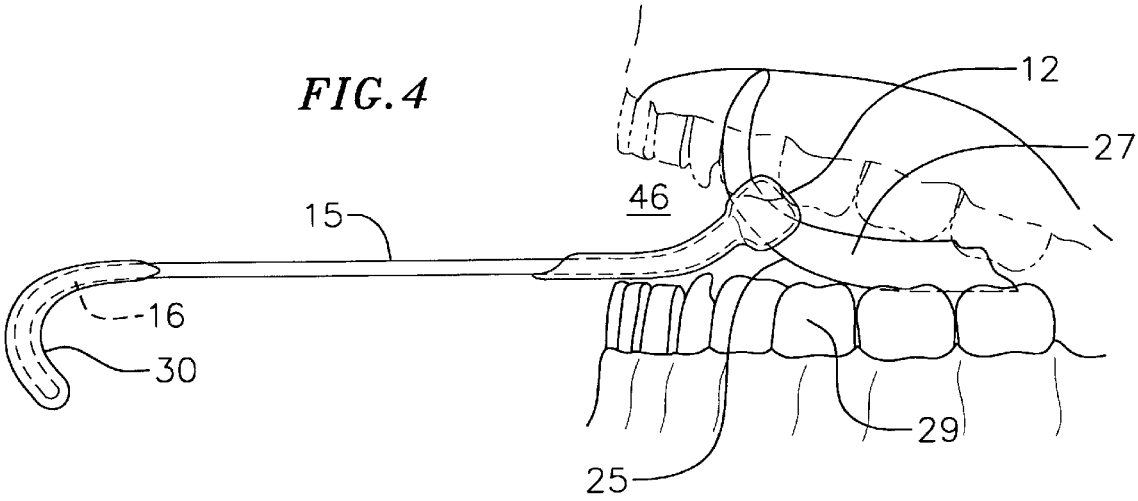
FIG. 4 is a side view of an exemplary embodiment tongue lifter of the present invention being used to elevate the tongue of a person in the appropriate position for pronouncing the /3˜/sound.

It is preferable that the tongue supporting surface normal axis 51 is offset at an angle relative to the stem central longitudinal axis 50 such that the lifter can be inserted into a person's mouth 46 with the stem 15 in a relatively horizontal position and with the holder 12 angled sufficiently relative to the stem for supporting the under surface 25 of the tongue 27 and for elevating the tongue in the proper position for pronouncing the sound /3˜/ as shown for example in FIG. 4. In this regard, minimum or no rotation of the lifter is required for positioning the tongue of a patient at the appropriate position without interfering with the patient's teeth 29.

Figure 5:
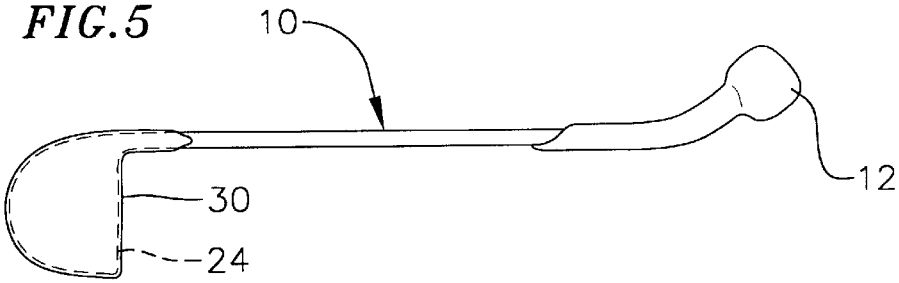
FIG. 5 is a side view of another exemplary embodiment tongue lifter of the present invention.

A handle 16 may be provided and the end of the stem. The handle may be a separate piece which may attached to the stem or may formed by bending a portion of the stem as shown in FIGS. 1 2, 4, 6, 7, and 8. Although the handle 16 shown in FIGS. 1, 2, 4, 6, 7 and 8 is a bent portion extending from the stem, other shapes of handles may be used. For example, the handle may be a plate 24 as shown in FIG. 5. Alternatively, the handle may be a "non-bent" end portion of the stem. The handle may be covered with a resilient, preferably non-toxic, material 30 such as nontoxic acrylic for providing a grip surface. Moreover, the neck, stem and handle may be formed from a single piece of material, as for example a rod that is bent one end forming the neck and bent at the other end forming the handle. The entire lifter may also be of unitary construction.

The entire lifter may be manufactured from stainless steel such as surgical stainless steel. The holder, the neck and preferably a part of the stem proximate the neck may be covered with a non-toxic resilient material 60 such as non-toxic acrylic as shown in the exemplary embodiments of FIGS. 1–6 for purposes of having a softer material interface with the patients mouth and tongue. The lifter itself may also be formed from other nontoxic materials such as non-toxic plastics. Consequently, the lifter 10 may not be covered with a non-toxic material as for example shown in FIG. 8. In this regard, the lifter may be made to be disposable. All the portions of the lifter that enter the mouth of a person should preferably be made from or covered with a non-toxic material.

Figure 6:
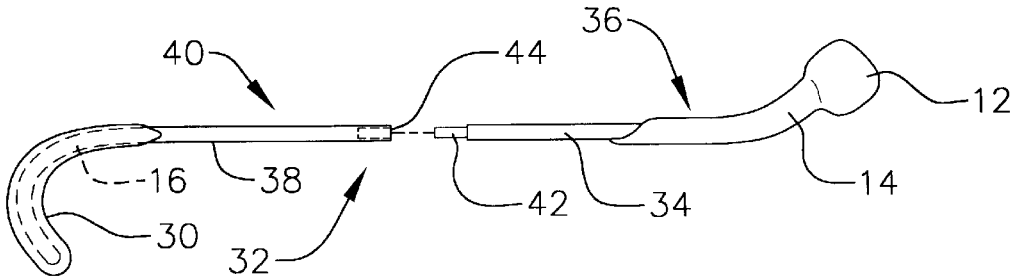
FIG. 6 is a side view of two-piece exemplary embodiment tongue lifter of the present invention.

In alternate exemplary embodiments, the lifter may be made as a two-piece part 32 as shown in FIG. 6. For example, the holder 12, the neck 14 and a portion of the stem 34 may form a first piece 36, while the remaining portion 38 of the stem and handle 16 if desired may form a second piece 40. The first piece may have a threaded stud 42 extending from the stem portion 34, while the remaining stem portion 38 may have a threaded bore 44 for accommodating the threaded stud 42, thereby allowing the first piece 36 to thread onto the second piece 40. Alternatively, the stud may be formed on the second piece while the threaded bore may be formed on the first piece. With a two-piece lifter, only the first piece, i.e., the piece that includes the holder need to be made or covered with a non-toxic material. Moreover, the first piece may be made to be disposable. Furthermore, interchangeable first pieces comprising different sizes of holders and/or different necks oriented at different angles relative to the stem for accommodating persons of different ages may be used. Besides use of a threaded stud 42/threaded bore 44 attachment configuration, other configurations that allow for quick connection and disconnection of the first and second pieces may also be used. Moreover, the tongue lifter may be "broken" at different locations for forming a two-piece tongue lifter. For example, the lifter may be "broken" at the neck, such that only the holder is detachable.

To use the lifter, to assist in the pronunciation of the /3˜/ sound, the speech therapist instructs the patient to elevate the tip of his/her tongue and pronounce the /3˜/ sound. The therapist then inserts the lifter into the patient's mouth 46 such that the holder cradles the under surface 25 of the patient's tongue 27. The lifter is then further pushed into the patient's mouth and rotated, if necessary, to a position, as for example that shown in FIG. 4, for elevating the rear or middle portion of the tongue to the appropriate position allowing the patient to properly pronounce the /3˜/ sound. If necessary the position of the lifter and thereby the tongue may be adjusted as necessary for proper pronunciation of the /3˜/ sound.

The lifter of the present invention may also used by individuals who want to practice proper tongue positioning for pronouncing the /3˜/ sound.

What is claimed is:

1. A tongue lifting tool comprising:

a tongue holder for cradling and lifting a patient's tongue in a patient's mouth, the tongue holder comprising a first surface for cradling the underside of the tongue and a second surface opposite the first surface; and a holding portion of sufficient length to extend outside of the patient's mouth while the tongue holder cradles the patient's tongue, the holding portion allowing for manipulation of the tongue holder from a location outside the patient's mouth, the holding portion comprising a portion adjacent a section of the tongue holder second surface and extending transversely from the section of the tongue holder second surface.

2. A tongue lifting tool as recited in claim 1 wherein the tongue holder comprises a concave surface, wherein said concave surface defines a concavity away from said holding portion.

3. A tongue lifting tool as recited in claim 1 wherein the tongue holder comprises a curved strip wherein said strip is curved in a direction away from said holding portion.

4. A tongue lifting tool as recited in claim 1 wherein the holding portion comprises:

a neck portion extending transversely from the tongue holder second surface;

a stem portion extending from the neck portion; and a handle portion extending from the stem portion.

5. A tongue lifting tool as recited in claim 4 wherein the holding portion is an integral unitary structure.

6. A tongue lifting tool as recited in claim 4 wherein the holding portion and handle are integral with each other forming a unitary structure.

7. A tongue lifting tool as recited in claim 4 wherein the neck portion extends at an angle relative to the stem portion.

8. A tongue lifting tool as recited in claim 7 wherein the stem portion comprises a longitudinal central axis and wherein the neck portion comprises a longitudinal central axis, and wherein the neck portion central longitudinal axis is offset from the stem portion central longitudinal axis at an angle less than 90°.

9. A tongue lifting tool as recited in claim 8 wherein the neck portion central longitudinal axis is offset from the stem portion central longitudinal axis at an angle in the range of about 20° to 30°.

10. A tongue lifting tool as recited in claim 1 wherein the tongue holder first surface is coated with a non-toxic material.

11. A tongue lifting tool as recited in claim 1 wherein the tongue holder is coated with a non-toxic material.

12. A tongue lifting tool as recited in claim 1 wherein the said tool is made from a non-toxic material.

13. A tongue lifting tool as recited in claim 1 wherein the tongue holder is releasably coupled to the handle.

14. A tongue lifting tool as recited in claim 13 wherein the tongue holder is made from a non-toxic material.

15. A tongue lifting tool as recited in claim 1 wherein a central normal axis extends from the first surface, wherein a portion of the holding portion adjacent to the section of the second surface comprises a central longitudinal axis, wherein the normal axis intersects the central longitudinal axis and wherein the normal axis is offset from the central longitudinal axis at an angle.

16. A tongue lifting tool as recited in claim 1 wherein the portion of the holding portion adjacent to a section of the tongue holder second surface extends perpendicularly from the section of the tongue holder second surface.

17. A tongue lifting tool comprising:

a cradle comprising a first cradling surface for cradling and lifting the underside of a patient's tongue and a second surface opposite the first cradling surface;

a holding portion comprising a portion adjacent to a section of the cradle second surface and extending transversely from the section of the cradle second surface, wherein the holding portion is rigidly coupled to the cradle and wherein the holding portion is of sufficient length for extending outside of a patient's mouth when the cradle is cradling the patient's tongue.

18. A tongue lifting tool as recited in claim 17 wherein the holding portion comprises:

a neck portion extending from the cradle second surface;

a stem portion extending from the neck portion; and a handle portion extending from the stem portion.

19. A tongue lifting tool as recited in claim 17 wherein the portion of the holding portion adjacent to a section of the cradle second surface extends perpendicularly from the section of the cradle second surface.

20. A tongue lifting tool as recited in claim 17 wherein the cradle is formed by bending an elongate strip of material.

21. A method for teaching the placement of a patient's tongue for making a sound, the method comprising:

providing a tongue lifting tool comprising a tongue holder having a cradling and lifting surface and a second surface opposite the cradling surface and a handle comprising a portion adjacent to a section of the tongue holder second surface and extending transversely from the section of the tongue holder second surface;

positioning the tongue holder in a patient's mouth with the handle extending outside of the patient's mouth;

cradling the underside of the patient's tongue in the tongue holder; and manipulating the handle to move the tongue to the appropriate position.

* * * * *